US007205495B2

(12) United States Patent
Mazur

(10) Patent No.: US 7,205,495 B2
(45) Date of Patent: Apr. 17, 2007

(54) CONTROL KNOB WITH MULTI-COLOR INDICATOR

(75) Inventor: James Mazur, Ft. Lauderdale, FL (US)

(73) Assignee: Stanton Magnets, Inc., Boynton Beach, FL (US)

( * ) Notice: Subject to any disclaimer, the term of this patent is extended or adjusted under 35 U.S.C. 154(b) by 0 days.

(21) Appl. No.: 11/170,594

(22) Filed: Jun. 29, 2005

(65) Prior Publication Data

US 2005/0236263 A1 Oct. 27, 2005

Related U.S. Application Data

(63) Continuation-in-part of application No. 10/755,756, filed on Jan. 12, 2004, now abandoned.

(51) Int. Cl.
*H01H 9/18* (2006.01)

(52) U.S. Cl. ..... 200/316

(58) Field of Classification Search ..... 200/308–317
See application file for complete search history.

(56) References Cited

U.S. PATENT DOCUMENTS 4,044,214 A * 8/1977 Rayburn et al. ..... 200/316
4,221,945 A * 9/1980 Mobus et al. ..... 200/316
5,204,502 A * 4/1993 Ferris et al. ..... 200/4
5,901,835 A * 5/1999 Hung ..... 200/316
5,913,414 A * 6/1999 Pollock et al. ..... 200/316
6,003,206 A * 12/1999 Hall et al. ..... 16/441
6,565,223 B2 * 5/2003 Liao et al. ..... 362/26
6,624,368 B2 * 9/2003 Sato et al. ..... 200/310
6,627,829 B2 * 9/2003 Sato ..... 200/310
6,667,446 B1 * 12/2003 Schuberth et al. ..... 200/4
6,744,374 B1 * 6/2004 Kuenzner ..... 340/815.78

* cited by examiner

*Primary Examiner*—Michael A. Friedhofer
(74) *Attorney, Agent, or Firm*—Day Pitney LLP

(57) ABSTRACT

A control knob for controlling an underlying signal is disclosed. The control knob includes a clear radial portion which serves as an indicator on the knob. The radial portion receives light from a multi-color LED which is housed within a clear shaft of a potentiometer which rotates in concert with the control knob and controls the level of the underlying signal. The multi-color LED emits light of a color which is dependent upon the level of the underlying signal being controlled by the control knob.

2 Claims, 2 Drawing Sheets

CONTROL KNOB WITH MULTI-COLOR INDICATOR

CROSS REFERENCE TO RELATED APPLICATION

This is a continuation-in-part of application Ser. No. 10/755,756 filed Jan. 12, 2004 now abandoned.

BACKGROUND OF THE INVENTION

1. Field of the Invention

This invention pertains to a control knob, particularly a control knob with a multi-color indicator which varies in color by way of a multi-color LED which varies in color in accordance with the electrical signal level being controlled by the control knob. The electrical signal level is typically used to control an audio output, but other outputs can be likewise controlled.

2. Description of the Prior Art

In the prior art, the use of control knobs to vary a signal, particularly an electrical signal which is used to control an audio output, is well known. However, as the number of control knobs on a control panel increases, and as faster and more intuitive responses are required from the human operator for many applications, the human operator may have difficulties in fully comprehending and processing the various control levels and the changes which may need to be made.

OBJECTS AND SUMMARY OF THE INVENTION

It is therefore an object of the present invention to provide a control knob for a signal, particularly an electrical signal which is used to control an audio output, which provides immediate, intuitive visual feedback as to the level of the electrical signal.

It is therefore a further object of the present invention to provide a control knob which provides visual feedback, but does not require extensive hardware changes to a control panel.

It is therefore a still further object of the present invention to provide a control knob which provides visual feedback, with little or no programming required from the user.

It is therefore a still further object of the present invention to provide a control knob which is simple and inexpensive to manufacture.

These and other objects are attained by providing a control knob with a clear or translucent pointer portion, wherein the control knob is placed over a multi-color LED which provides light output which passes through the clear or translucent pointer portion. The color of the light emanating from the multi-color LED is varied in accordance with the output level of the electrical control signal which is controlled by the knob. Therefore, in the case of a dual color LED, a relatively high level of electrical control signal will result in a first color being passed through the clear or translucent pointer portion while a relatively low level of electrical control signal will result in a second color being passed through the clear or translucent pointer portion. In the case of a three color LED, then yet another color is passed through the clear or translucent pointer portion in response to a relatively intermediate level of electrical control signal.

BRIEF DESCRIPTION OF THE DRAWINGS

Further objects and advantages of the invention will become apparent from the following description and from the accompanying drawings, wherein.

DETAILED DESCRIPTION OF THE PREFERRED EMBODIMENT

Figure 1:
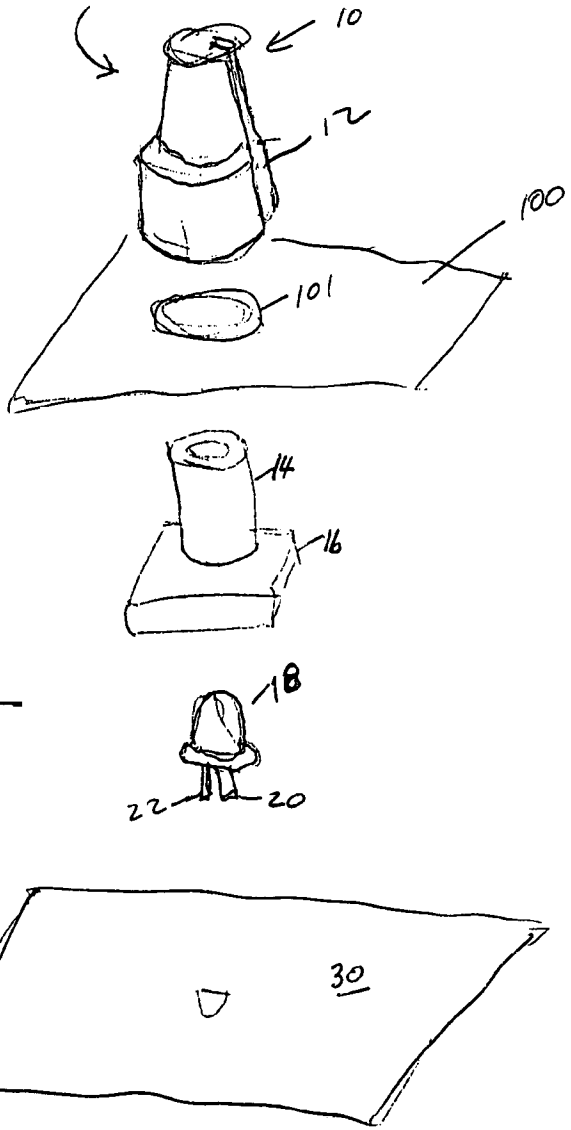
FIG. 1 is an exploded view of the control knob of the present invention.
Figure 2:
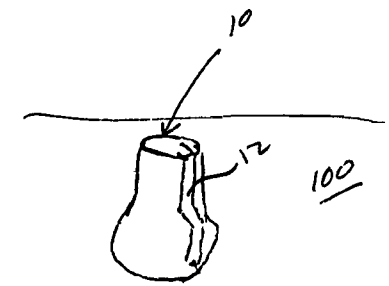
FIG. 2 is a perspective view of the control knob of the present invention on a control panel.

Referring now to the drawings in detail wherein like numerals refer to like elements throughout the several views, one sees that FIG. 1 is an exploded view of control knob 10, while FIG. 2 shows the control knob 10 on a control panel 100.

Figure 3:
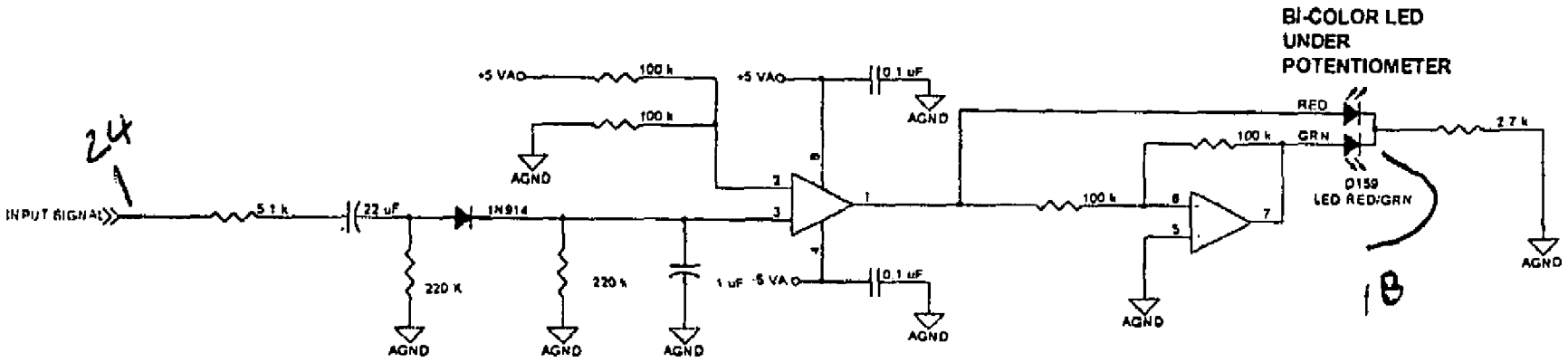
FIG. 3 is a schematic of the circuitry associated with the multi-color LED of the control knob of the present invention.

Control knob 10 is hollow and is typically essentially rotationally symmetric. However, different applications may require differently shaped control knobs 10. Control knob 10 includes a radial section 12 of clear or translucent plastic for the passage or channeling of light. Radial section 12 further typically serves as a pointer to indicia (not shown) on control panel 100. The clear or translucent control shaft 14 of potentiometer 16 passes through aperture 101 of control panel 100 and is secured to control knob 10 so that control shaft 14 rotates in concert with control knob 10. The position of control knob 10 controls the resistance of potentiometer 16 so as to control the level of the underlying signal. For instance, the "off" position of control knob 10 may position radial section 12 at about the seven or eight o'clock position. The underlying electrical signal is typically switched "off" at this position. As the control knob 10 is rotated clockwise to a maximum "on" position so that radial section 12 is at about the four or five o'clock position, the underlying electrical signal is increased by way of the reduction of resistance of potentiometer 16. Multiple color LED (light emitting diode) 18 extends into clear control shaft 14 of potentiometer 16. Multiple color LED 18 emits one of a multiple (typically two or three) of colors dependent upon the voltage across terminals 20, 22 of LED 18. Terminals 20, 22 are affixed to control board 30. Control board 30 includes the circuitry of FIG. 3 so that the input signal 24 which is controlled by the rotational position of potentiometer 16 controls the voltage across terminals 20, 22 of LED 18. As the voltage level increases past a threshold, the color output of LED 18 changes from a first color to a second color. If multi-color LED 18 can emit more than two colors, then a different color will be emitted as the voltage level passes through an intermediate range. The light emitted from LED 18 is passed through clear control shaft 14 of potentiometer 16 and then through radial section 12 thereby allowing the user to view the color of the LED 18. This provides a visual indication to the user as to the level of the underlying signal being controlled by control knob 10.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A control knob, including:

a control device for controlling a level of a signal in response to a position of said knob, said control device including a potentiometer which varies resistance in response to rotation of said control knob, said potentiometer including a hollow shaft which rotates in concert with rotation of said knob;

a light emitting device which emits light of a color chosen from at least two colors dependent upon said level of said signal;

wherein said hollow shaft is clear or translucent and said light emitting device is placed within said hollow shaft; and a portion of said knob receiving and passing said emitted light for viewing by a user.

2. A control knob, including:

a control device for controlling a level of a signal in response to a position of said knob, said control device including a potentiometer which varies resistance in response to rotation of said control knob;

a multi-color light emitting diode (LED) which emits light of a color chosen from at least two colors dependent upon said level of said signal;

a radial portion of said knob being clear or translucent and receiving and passing said emitted light for viewing by a user;

wherein said potentiometer includes a hollow shaft which rotates in concert with rotation of said knob; and wherein said hollow shaft is clear or translucent and said light emitting diode is placed within said hollow shaft, wherein light emitted from said light emitting diode passes through said hollow shaft and through said radial portion.

* * * * *